US006290609B1

(12) United States Patent
Takeda

(10) Patent No.: US 6,290,609 B1
(45) Date of Patent: Sep. 18, 2001

(54) IRON GOLF CLUB

(75) Inventor: Hitoshi Takeda, Tsubame (JP)

(73) Assignee: K.K. Endo Seisakusho, Niigata-ken (JP)

( * ) Notice: Subject to any disclaimer, the term of this patent is extended or adjusted under 35 U.S.C. 154(b) by 0 days.

(21) Appl. No.: 09/398,700

(22) Filed: Sep. 20, 1999

(30) Foreign Application Priority Data

Mar. 11, 1999 (JP) ..... 11-065632

(51) Int. Cl.[7] ..... A63B 53/04; A63B 53/08
(52) U.S. Cl. ..... 473/335; 473/350
(58) Field of Search ..... 473/324, 334, 473/335, 336, 337, 338, 339, 340, 349, 350, 290, 291, 256, 219, 226

(56) References Cited

U.S. PATENT DOCUMENTS 1,133,129 * 3/1915 Govan .
2,328,583 * 9/1943 Reach .
3,652,094 * 3/1972 Glover .
4,340,230 * 7/1982 Churchward .
4,754,977 * 7/1988 Sahm .
5,013,041 * 5/1991 Sun .
5,050,879 * 9/1991 Sun .
5,297,794 * 3/1994 Lu .
5,385,348 * 1/1995 Wargo .
5,439,223 * 8/1995 Kobayashi .
5,599,243 * 2/1997 Kobayashi .
6,015,354 * 1/2000 Ahn .
6,077,171 * 6/2000 Yoneyama .

FOREIGN PATENT DOCUMENTS

2269110 * 2/1994 (GB) ..... 273/167 R
53-288 1/1978 (JP) .
7-59883 3/1995 (JP) .
092015374 * 9/1992 (WO) ..... 273/173

* cited by examiner

*Primary Examiner*—Sebastiano Passaniti
(74) *Attorney, Agent, or Firm*—Quarles & Brady LLP

(57) ABSTRACT

An iron golf club which enables a further fine adjustment of the weight balance, moment of inertia and the like of a head. Four vertical balance weights 11A, 11B, 11C and 11D are disposed on different positions on a rear face 10, respectively. The first and fourth vertical balance weights 11A and 11D of larger specific gravity are provided on a toe or heel side of the rear face 10A. In the center of the rear face 10A are provided the second and third vertical balance weights 11B and 11C of smaller specific gravity. Through the combination of the balance weights 11A, 11B, 11C and 11D of various shapes and specific gravity, the weight balance of the head 1 can be freely adjusted. Also, the position of the center of gravity of the head 1 can be positioned backwards, thus enlarging the sweet area. In addition, as the denser balance weights 11A and 11D are provided near the toe 7 or the heel 6, the toe 7 and heel 6 of the head 1 can be weighted.

6 Claims, 8 Drawing Sheets

IRON GOLF CLUB

BACKGROUND OF THE INVENTION

1. Field of the Invention

The present invention relates to an iron golf club having a balance weight provided on a rear face of a head body thereof.

2. Description of the Related Art

Golf clubs which comprise a head and a shaft, are generally classified as one of three types: a wood, an iron, or a putter. Irons are classified by the loft angle of their head. Irons with a small loft angle (for example, from 20 to 30 degrees) are called "long irons", while irons with a large loft angle (for example, from 40 to 50 degrees) are called "short irons". Normally, irons are numbered in ascending order from longest to shortest, for example, Nos. 1, 2, 3, 4, 5, 6, 7, 8, 9 and PW (pitching wedge).

The head of an iron club may have a concave back (a cavity-back iron) on the rear of the face which is the front of the head for hitting golf balls, or may have a smooth back (a solid-back iron). The front has an area known by such names as "the sweet spot".

It is widely recognized that to enlarge such sweet spot, the center of gravity of the head may be positioned as rearwardly as possible. In Japanese Patent Un-Examined Publication No.7-59883, which was filed by the same assignee as that of the present application, is proposed a means for providing a club head with such rearwardly positioned center of gravity, in which the rear face of the head body is formed with a cavity, into which is securely fitted a balance weight. Further, in Japanese Utility Model Examined Publication No.53-288 is taught a golf club which is provided with a plurality of balance weights along a peripheral edge of a rear face of a head.

The head disclosed in the Publication No.7-59883 has a single balance weight only, so that there is a limit in adjusting the position of the center of gravity of the head or the head balance. On the other hand, the head disclosed in the Publication No.53-288 is provided with a plurality of balance weights, and thus the degree of freedom in doing so is able to be improved.

Whereas, as the Publication No.53-288 proposes that the balance weights are biasedly arranged, the fine adjustment of the weight balance and/or moment of inertia of the head required for respective club heads such as for the 1st iron or for the 2nd iron, would be impossible.

SUMMARY OF THE INVENTION

The present invention addresses the above-mentioned problems, with the object of providing an iron golf club having a plurality of balance weights provided on a rear face of a head body thereof, wherein each of said balance weights is separate from said head body, elongated either vertically or horizontally, arranged in parallel. Thus, the weight balance of the head can be freely set.

According to another aspect of the invention, there is provided an iron golf club having a plurality of balance weights provided on a rear face of a head body thereof, wherein each of said balance weights is separate from said head body, formed into a fragmentary shape such as pillar, cone, pyramid or hexagon pillar etc., arranged in a honeycomb-like manner. Thus, the weight balance of the head can be freely set, using these fragmentary balance weights.

BRIEF DESCRIPTION OF THE DRAWINGS

Other objects, features and advantages of the invention will become apparent to those skilled in the art, from the following description of the preferred embodiments of the invention, wherein reference is made to the accompanying drawings, in which.

DESCRIPTION OF THE PREFERRED EMBODIMENTS

Figure 1:
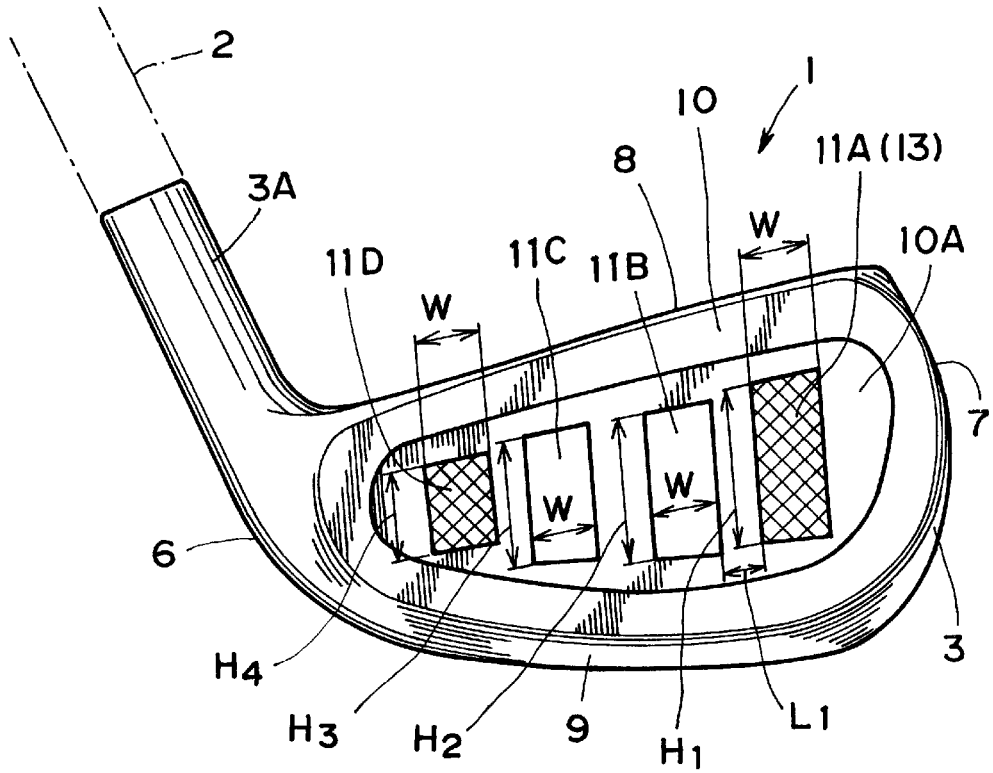
FIG. 1 is a rear view showing an iron golf club in accordance with a first embodiment of the invention.
Figure 2:
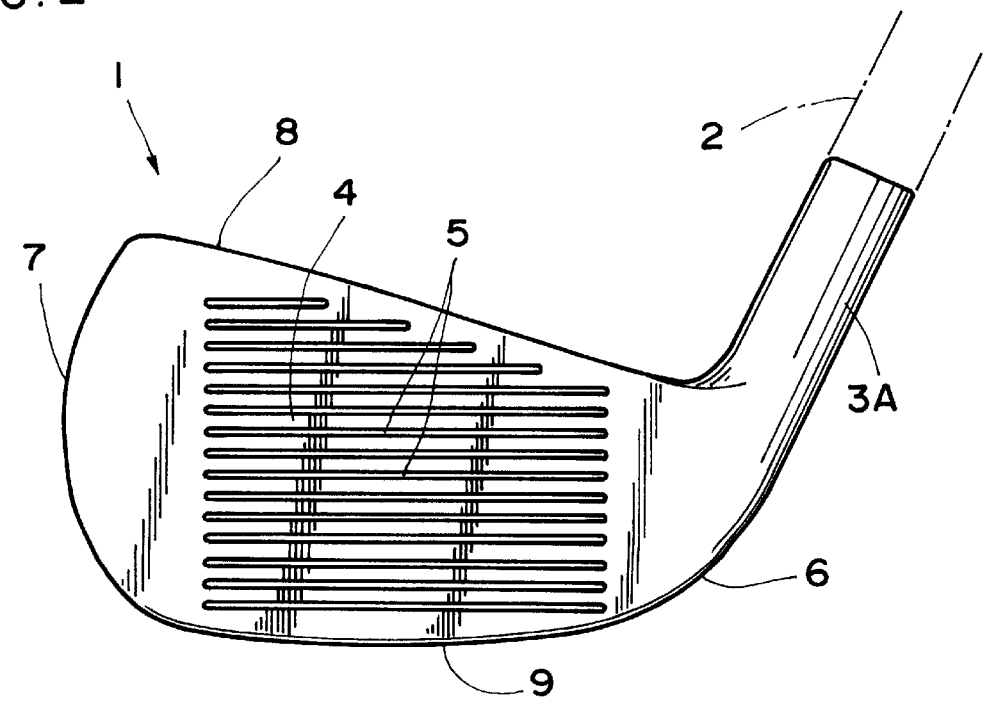
FIG. 2 is a front view showing an iron golf club in accordance with a first embodiment of the invention.

As follows is a description of embodiments of the present invention with reference to the appended drawings. In FIGS. 1 through 4 showing a first embodiment of the invention, there is illustrated a so-called solid-back iron golf club which has a flat rear face. The iron golf club comprises a head 1 and a shaft 2 connected to one end of the head 1. The head 1 is made of a metal such as steel, and is formed on one side of a head body 3 with a shaft attachment portion 3A which is called a hosel or the like, on a front face with a flat face 4 for striking balls (not shown), said face 4 being formed with a plurality of horizontal grooves 5 called score lines. Moreover the head 1 is respectively formed, on one side of the head body 3 with a heel 6, on an other side thereof with a toe 7, on an upper side with a top 8, and on a lower side with a sole 9. In addition, as to the dimension defined between the face 4 and a rear face 10, a thickness T on the sole 9 side is formed greater than a thickness t on the top 8 side (T>t).

There are provided a plurality of vertical balance weights 11A,11B, 11C and 11D on a rear portion 10A in the aforesaid rear face 10, said rear portion 10A nearly corresponding to the face 4 so that it has substantially the same area and shape as the face 4. In a preferred form of the invention, four balance weights 11A,11B, 11C and 11D are provided, each being embedded so that a rear face 13 thereof may be nearly flush with the rear portion 10A. These vertical balance weights 11A,11B, 11C and 11D are each separate from the head body 3, made of a material whose density is different from that of the head body 3, and are vertically elongated so as to extend from the top 8 side to the sole 9 side. These balance weights 11A,11B, 11C and 11D are arranged in parallel, at nearly equal intervals of the dimension "Li" from the toe 7 to the heel 6. In other words, the first vertical balance weight 11A is located on the toe 7 side in the rear portion 10A, elongated from the top 8 to the sole 9. The fourth vertical balance weight 11D is located on the heel 6 side in the rear portion 10A, elongated from the top 8 to the sole 9. The second and third vertical balance weights 11B and 11C are located between the first and fourth vertical balance weights 11A and 11D, elongated in the same manner.

It should be noted that these first through fourth vertical balance weights 11A, 11B, 11C and 11D are so formed that the volume thereof may decrease in sequence. Namely, these first through fourth vertical balance weights 11A, 11B, 11C and 11D are formed so that they may have substantially the same width "W", while their vertical lengths H1,H2,H3 and H4 are gradually decreased in ascending order (i.e., H1>H2>H3>H4). Further, the specific gravity of the materials of the first and fourth vertical balance weights 11A and 11D, which are denoted by G1 and G4 respectively, are larger than the specific gravity of the materials of the second and third vertical balance weights 11B and 11C, which are denoted by G2 and G3, respectively (i.e., G1,G4>G2,G3). More specifically, in the event that the head body 3 is formed from an iron-based material such as steel, the material of the first and fourth vertical balance weights 11A and 11D may be the one whose specific gravity is 7 or above, such as copper, nickel, tungsten or their alloys, while the material of the second and third vertical balance weights 11B and 11C may be the one whose specific gravity is 5 or below, such as magnesium, aluminium, titanium or their alloys, thereby forming the head 1. It should be noted that the first through fourth vertical balance weights 11A,11B,11C, and 11D do not appear on the face 4, and that the vertical balance weights 11A and 11D formed from the material of the larger specific gravity G1,G4 are illustrated with grid patterns in the drawing for explanation purpose only, thus distinguishing them from the vertical balance weights 11B and 11C formed from the material of the smaller specific gravity G2,G3.

Next, a method for manufacturing the head 1 is explained.

Figure 3:
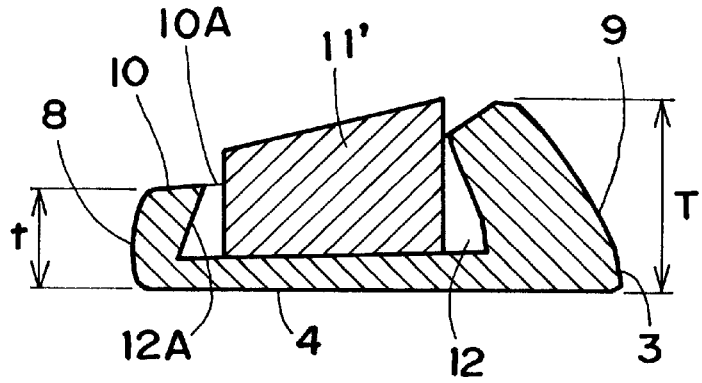
FIG. 3 is a section of an iron golf club in accordance with a first embodiment of the invention, particularly illustrating an iron golf club which is being manufactured.
Figure 4:
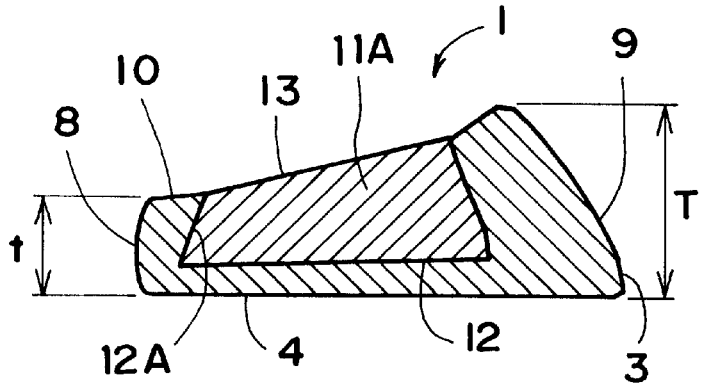
FIG. 4 is a section of a head of an iron golf club in accordance with a first embodiment of the invention.

As shown in FIGS. 3 and 4, the rear portion 10A of the head body 3, which is formed by forging, is formed with vertical grooves 12 which are open toward a rear, corresponding to the positions of the first through fourth vertical balance weights 11A,11B,11C and 11D, respectively. Then, a block 11' which is formed from a metallic material of the preset specific gravity, having substantially the same volume as the groove 12, is inserted into each groove 12, thus attaching the blocks 11' to the grooves 12 by applying pressure using a press device. In the present embodiment, a peripheral face 12A of each groove 12 is reverse-tapered, so that the balance weights 11 are securely attached in a mortise/tenon joint.

When striking a ball with the above-structured head 1, you swing the golf club, with a grip portion (not shown) of the shaft 2 being gripped to strike a ball on the face 4. At that time, as the four vertical balance weights 11A, 11B,11C and 11D are disposed in the respective different positions on the rear face 10 of the head 1, the weight balance of the head 1 can be freely adjusted, through the combination of the vertical balance weights 11A, 11B,11C and 11D of various shapes and specific gravity. Further, as the first and fourth vertical balance weights 11A and 11D that are denser ones, are positioned closer to the rear portion 10A, the position of the center of gravity of the head 1 can be positioned backwards, thus enlarging the sweet area. Moreover, the second and third vertical balance weights 11B and 11C, which are less dense ones, are disposed in the center of the rear portion 10A, while the denser first and fourth vertical balance weights 11A and 11D are disposed close to the toe 7 or heel 6, so that the toe 7 and heel 6 of the head 1 can be weighted, thus enabling the free setting of the position of the center of gravity, moment of inertia and even the position of the sweet area, according to a particular use demanded.

Additionally, as the first through fourth vertical balance weights 11A, 11B, 11C and 11D are provided in the rear portion 10A, opposite to the face 4, the face 4 can be thickened, thereby improving the feel of striking. In addition, as the rear portion 10A of the head 1 is substantially flush with each rear face 13 of the vertical balance weights 11A, 11B,11C and 11D, the appearance of the rear face 10 can be made more attractive.

Next, other embodiments of the invention are described, in which the same portions as those described in the first embodiment are designated as the same reference numerals, and their repeated detailed descriptions are omitted.

Figure 5:
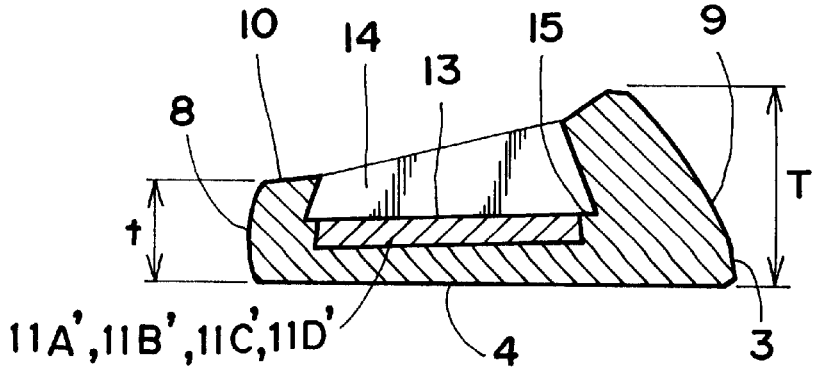
FIG. 5 is a section of an iron golf club in accordance with a second embodiment of the invention.

In FIG. 5 showing a second embodiment, there is provided a so-called cavity-back iron whose head 1 is formed on the inside of the rear face 10 with a recess 14 called "cavity". A bottom surface 15 of the recess 14 is formed with the grooves 12, in which are provided first to fourth vertical balance weights 11A', 11B',11C' and 11D', like the first embodiment. The bottom surface 15 is positioned nearly opposite to the face 4, having substantially the same area and shape as the face 4. In the second embodiment, the rear faces 13 are nearly flush with the bottom surface 15.

It should be noted that the same effect as the first embodiment can be attained even though the four vertical balance weights 11A', 11B',11C' and 11D' are provided on such cavity-back iron.

Figure 6:
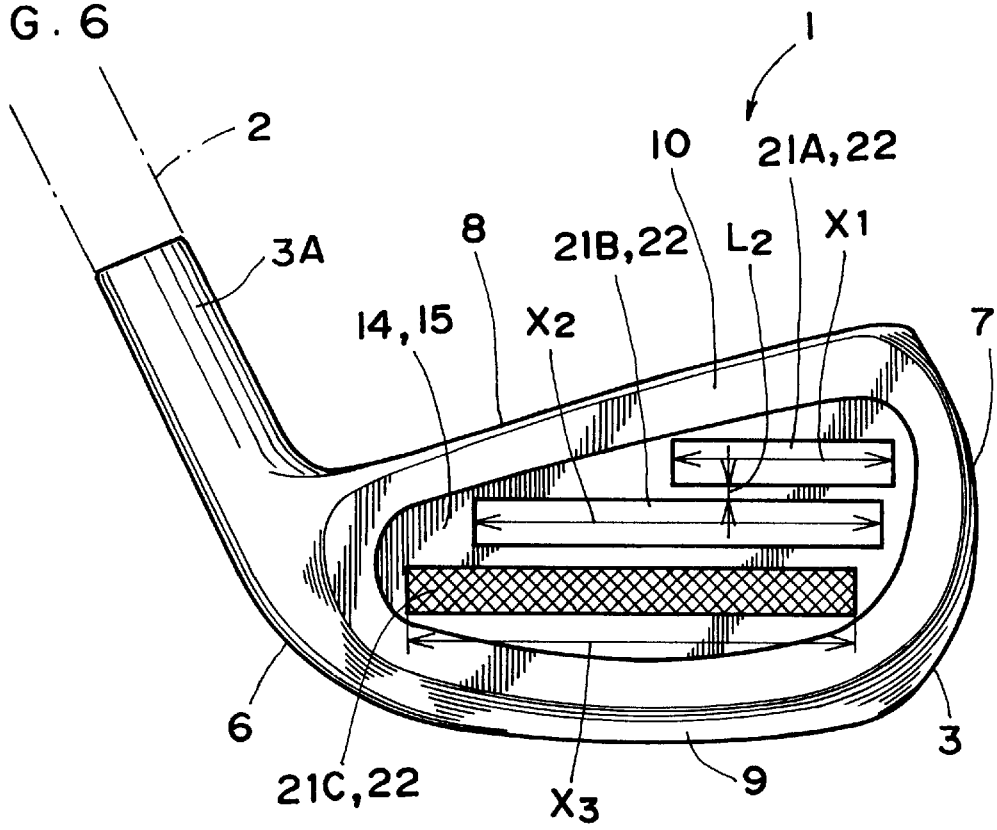
FIG. 6 is a rear view showing an iron golf club in accordance with a third embodiment of the invention.
Figure 7:
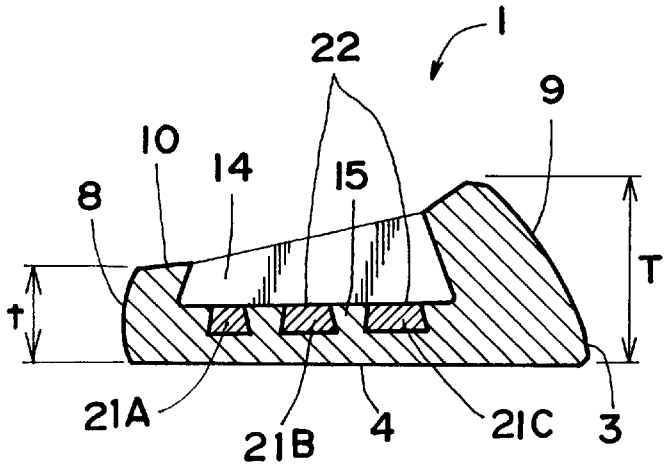
FIG. 7 is a section of an iron golf club in accordance with a third embodiment of the invention.

In FIGS. 6 and 7 showing a third embodiment, there is also provided a so-called cavity-back iron whose head 1 is formed on the inside of the rear face 10 with the recess 14 called "cavity". Likewise, the bottom surface 15 is positioned nearly opposite to the face 4, having substantially the same area and shape as the face 4.

In the embodiment, the bottom surface 15 is provided with a plurality of horizontal balance weights 21A,21B and 21C, which, in the present embodiment, are embedded into three different positions thereof so that the respective rear faces 22 of these horizontal balance weights may be flush with the bottom surface 15. These first to third horizontal balance weights 21A,21B and 21C are separate from the head body 3, each being made of a material whose specific gravity is different from that of the head body 3, being horizontally or sideways extended from the heel 6 toward the toe 7. These first to third horizontal balance weights 21A,21B and 21C are provided in parallel at nearly equal intervals of dimension "L2", from the top 8 to the sole 9. In other words, the first horizontal balance weight 21A is positioned close to the top 8 side on the bottom surface 15 thereof, elongated from the heel 6 side to the toe 7 side. The third horizontal balance weight 21C is positioned close to the sole 9 on the bottom surface 15 thereof, elongated from the heel 6 side to the toe 7 side. The second horizontal balance weight 21B is positioned between the first and third horizontal balance weights 21A and 21C, elongated sideways in the same manner. These first to third horizontal balance weights 21A, 21B and 21C have increasing volumes in sequence. In other words, the horizontal length X1 of the first horizontal balance weight 21A is less than the horizontal length X2 of the second horizontal balance weight 21B, while the horizontal length X2 of the second horizontal balance weight 21B is less than the horizontal length X3 of the third horizontal balance weight 21C (i.e.,X1<X2<X3). Further, the rear face 22 of each of the first to third horizontal balance weights 21A, 21B and 21C is formed nearly flush with the bottom surface 15 of the recess 14.

In addition, the specific gravity of the material of the third horizontal balance weight 21C is greatly than that of the first and second horizontal balance weight 21A and 21B. More specifically, in the event that the head body 3 is formed for example from an iron-based material such as steel, the material of the third horizontal balance weight 21C may be one whose specific gravity is nearly 7 or above, such as copper, nickel, tungsten or their alloys, while each material of the first and second horizontal balance weights 21A and 21B may be one whose specific gravity is nearly 5 or below such as magnesium, aluminium, titanium or their alloys, thereby forming the head 1. It should be noted that the first to third horizontal balance weights 21A, 21B and 21C do not appear on the face 4, and that the third horizontal balance weight 21C formed from the denser material is illustrated with grid patterns in the drawing, thus distinguishing it from the first and second horizontal balance weights 21A and 21B formed from the less dense material.

When striking a ball with the above-structured head, you swing the golf club, with a grip portion (not shown) of the shaft 2 being gripped to strike a ball on the face 4. At that time, as the three horizontal balance weights 21A, 21B and 21C are disposed in the respective different positions in the recess 14 on the rear face 10 of the head 1, the weight balance of the head 1 can be freely adjusted, through the combination of the horizontal balance weights 21A, 21B and 21C of various shapes and specific gravity. Further, as the third horizontal balance weight 21C that is denser one is positioned near the sole 9, the position of the center of gravity of the head 1 can be positioned toward the sole 9, thus enlarging the sweet area. More specifically, as the first and second horizontal balance weights 21A and 21B of less densities are disposed in the upper and intermediate positions, while the denser third horizontal balance weight 21C is disposed close to the sole 9, the portion near the sole 9 side can be weighted, thus enabling the free setting of the position of the center of gravity, moment of inertia and even the position of the sweet area, according to a particular use. In addition to the foregoing, the first to third horizontal balance weights 21A, 21B and 21C are disposed on the bottom surface 15 which is cavity-shaped, positioned opposite to the face 4, whereby the face 4 can be thickened to thereby improve the feel of striking.

Figure 8:
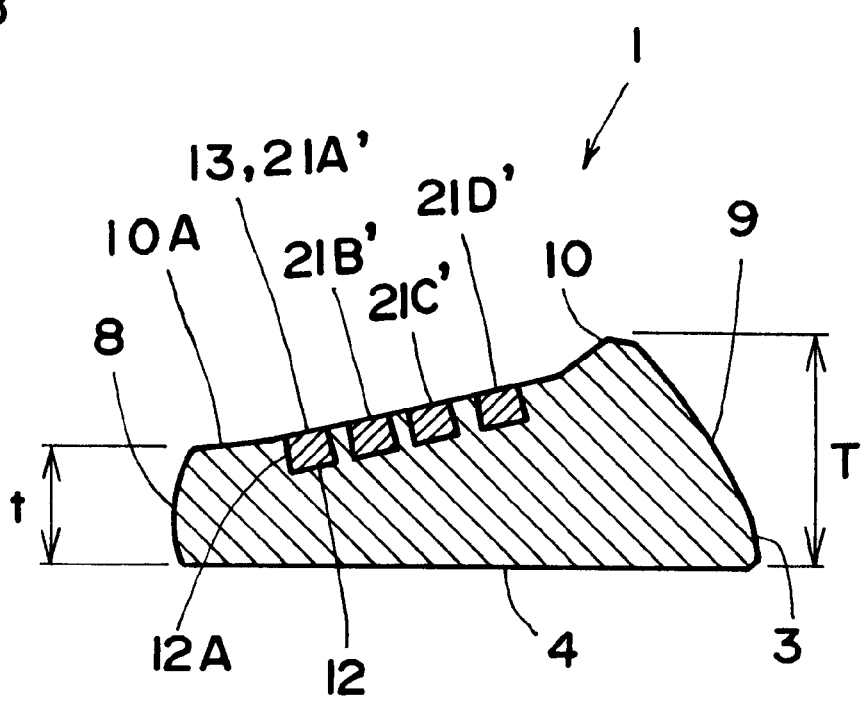
FIG. 8 is a section of an iron golf club in accordance with a fourth embodiment of the invention.

Referring to FIG. 8 showing a fourth embodiment, there is shown an iron golf club of so-called solid-back type, like the first embodiment. A plurality of horizontal balance weights 21A', 21B',21C' and 21D' are provided on the rear portion 10A. In the present embodiment, they are provided on four different positions, and embedded with each rear face 13 being nearly flush with the rear portion 10A.

Figure 9:
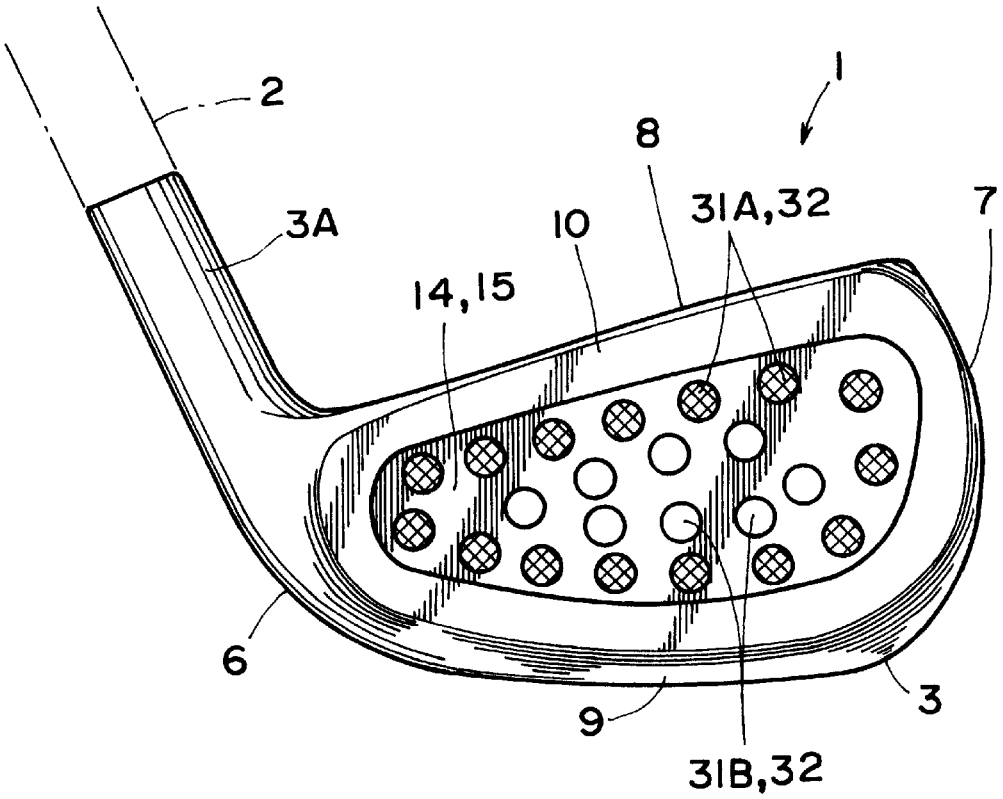
FIG. 9 is a rear view showing an iron golf club in accordance with a fifth embodiment of the invention.
Figure 10:
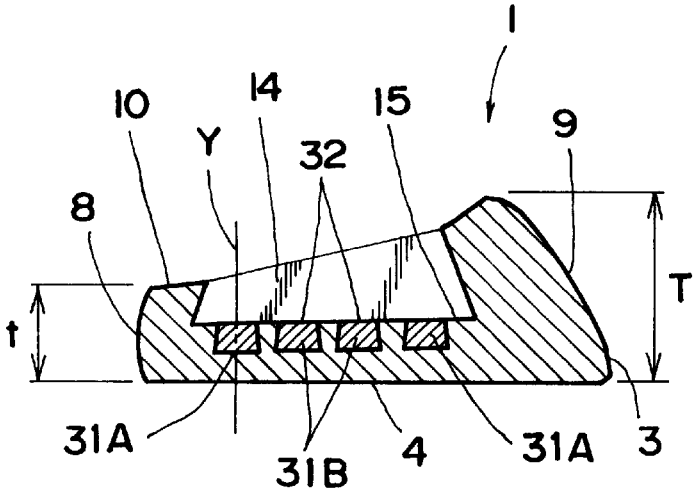
FIG. 10 is a section of an iron golf club in accordance with a fifth embodiment of the invention.

Referring to FIGS. 9 and 10 showing a fifth embodiment, there is shown an iron golf club of so-called cavity-back type whose head 1 is formed inside the rear face 10 with the recess 14 called "cavity". The bottom surface 15 of the recess 14 has substantially the same area and shape as the face 4, positioned opposite thereto. Further, the bottom surface 15 is provided with a plurality of fragmentary balance weights 31A and 31B. In the present embodiment, they are embedded in plural different positions, with a rear face 32 of each balance weight being nearly flush with the bottom surface 15. These balance weights 31A and 31B are separate from the head body 3, formed from a material whose specific gravity is different from that of the head body 3, and are each shaped into a fragmentary shape such as pillar, cone, triangle, triangular pillar, square pyramid, and square pillar or like, with the respective Y axis being nearly normal to the bottom surface 15. In the embodiment is illustrated are pillar-shaped ones. The first balance weights 31A are spacedly provided along a peripheral face of the bottom surface 15, while the second balance weights 31B are arranged along the inside of the first balance weights 31A. It should be noted that the specific gravity of the material of the first balance weights 31A is greater than that of the second balance weights 31B.

More specifically, in the event that the head body 3 is formed for example from an iron-based material such as steel, the material of the first balance weights 31A may be one whose specific gravity is nearly 7 or above, such as copper, nickel, tungsten or their alloys, while the material of the second balance weights 31B may be one whose specific gravity is nearly 5 or below such as magnesium, aluminium, titanium or their alloys, thereby forming the head 1. It should be noted that the first and second balance weights 31A and 31B do not appear on the face 4, and that the first balance weights 31A made from the denser material are illustrated with grid patterns, thus distinguishing them from the second balance weights 31B made from the less dense material.

When striking a ball with the above-structured head, you swing the golf club, while gripping a grip portion (not shown) of the shaft 2 to strike a ball on the face 4. At that time, as the balance weights 31A, 31B are disposed in the above-mentioned manner in the recess 14 on the rear face 10 of the head 1, the weight balance of the head 1 can be freely adjusted, through the combination of the balance weights 31A, 31B of various shapes and specific gravity. Further, the first balance weights 31A that are denser ones are positioned along the periphery of the bottom surface 15 of the recess 14, while the second balance weights 31B that are of less density are arranged along the inside periphery of the first balance weights 31B, whereby the weight of the head 1 can be distributed toward around the center of gravity of the head 1, thus enlarging the sweet area. At the same time, the free setting of the position of the center of gravity, moment of inertia and even the position of the sweet area are realized according to a particular use demanded. Moreover, the balance weights 31A and 31B are each formed into a fragmentary shape, the fine adjustment of the above-mentioned factors are possible. In addition to the foregoing, the first and second balance weights 31A and 31B are provided in the bottom surface 15 that is opposite to the face 4, thus enabling the thickening of the face 4 to thereby improve the feel of striking.

Figure 11:
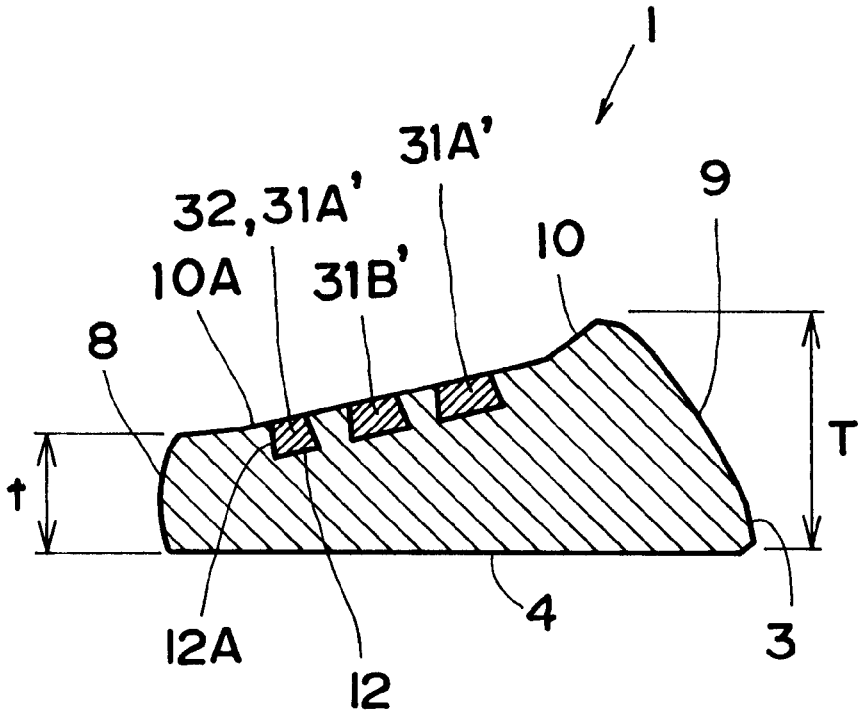
FIG. 11 is a section of an iron golf club in accordance with a sixth embodiment of the invention.

Referring to FIG. 11 showing a sixth embodiment, there is shown an iron golf club of so-called solid-back type, like the first embodiment. A plurality of fragmentary balance weights 31A', 31B', are provided on the rear portion 10A, like the fifth embodiment. The first balance weights 31A' are spacedly provided along a periphery, while the second balance weights 31B' are arranged along the inside of the first balance weights 31A'. It should be noted that the specific gravity of the material of the first balance weights 31A' is greater than that of the second balance weights 31B', and they are embedded so that their rear faces 32 may be nearly flush with the rear portion 10A.

Figure 12:
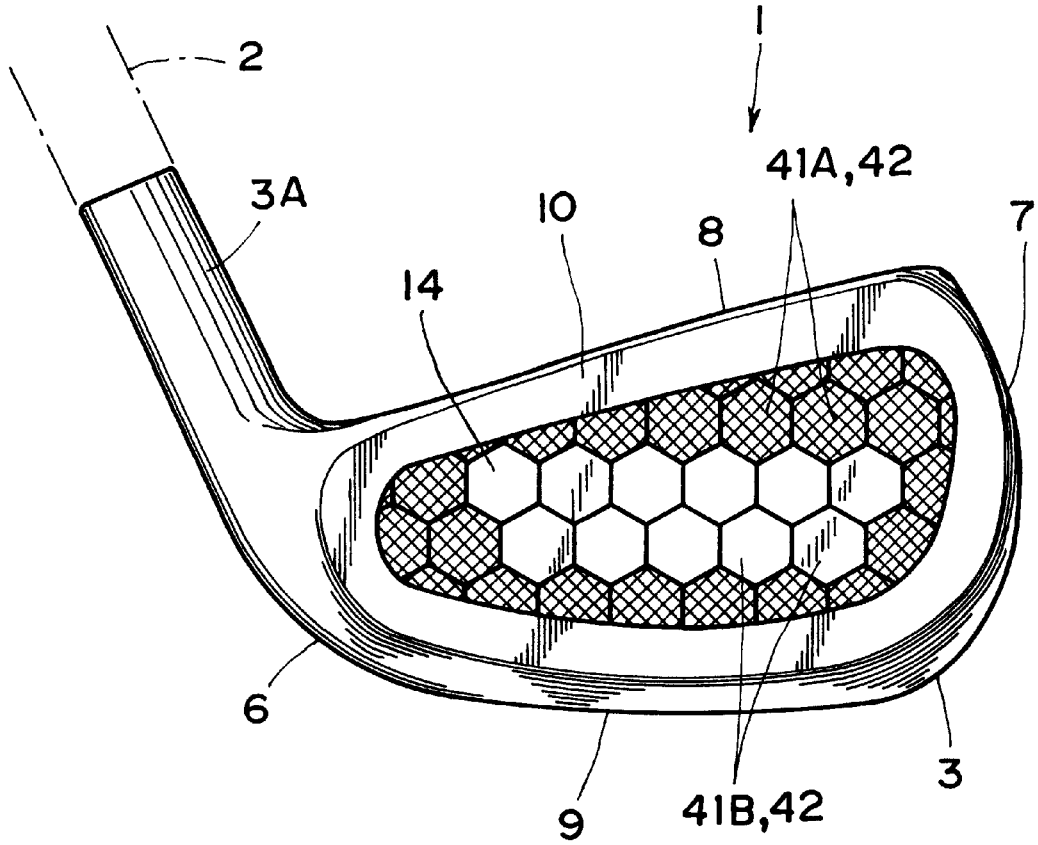
FIG. 12 is a rear view showing an iron golf club in accordance with a seventh embodiment of the invention.
Figure 13:
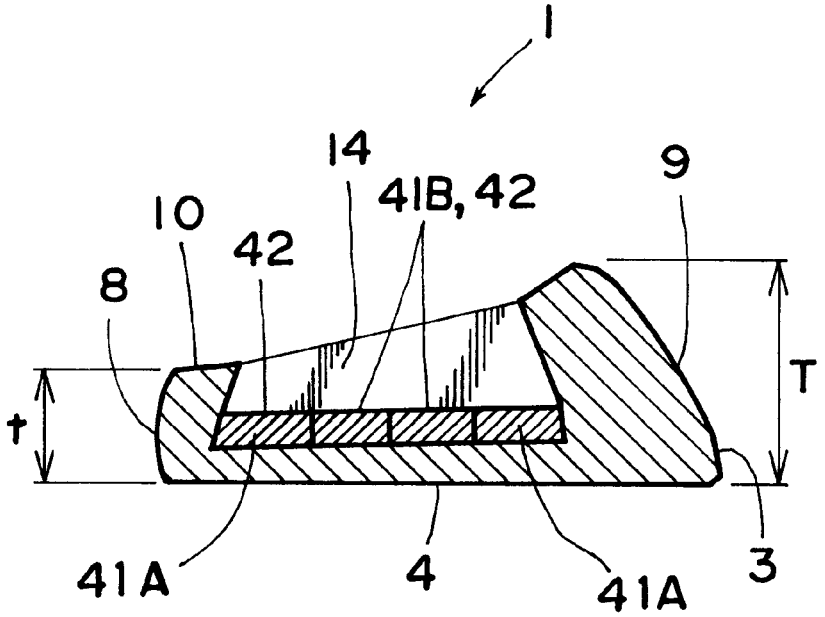
FIG. 13 is a section of an iron golf club in accordance with a seventh embodiment of the invention.

Referring to FIGS. 12 and 13 showing a seventh embodiment, there is shown an iron golf club of so-called cavity-back type whose head 1 is formed inside the rear face 10 with the recess 14 called "cavity". The bottom surface 15 of the recess 14 has substantially the same area and shape as the face 4, positioned opposite thereto. Further, the bottom surface 15 is provided with a plurality of fragmentary balance weights 41A and 41B, each having hexagon-shaped rear faces, arranged in a honeycomb-like manner. The balance weights 41A and 41B are each shaped into a short pillar having such hexagon-shaped rear face, and are attached to the bottom surface 15 by applying pressure or through bonding. In the present embodiment, they are densely arranged in parallel so that the respective rear faces 42 thereof may be nearly flush with one another. These balance weights 41A and 41B are separate from the head body 3, formed from a material whose specific gravity is different from that of the head body 3. The first balance weights 41A are spacedly provided along the peripheral face of the bottom surface 15, while the second balance weights 41B are arranged along the inside periphery of the first balance weights 41A. It should be noted that each specific gravity of the material of the first balance weights 41A is greater than that of the second balance weights 41B.

More specifically, in the event that the head body 3 is formed for example from an iron-based material such as steel, the material of the first balance weights 41A may be one whose specific gravity is nearly 7 or above, such as copper, nickel, tungsten or their alloys, while the material of the second balance weights 41B may be one whose specific gravity is nearly 5 or below such as magnesium, aluminium, titanium or their alloys, thereby forming the head 1. It should be noted that the first and second balance weights 41A, 41B do not appear on the face 4, and that the first balance weights 41A made from the denser material are illustrated with grid patterns in the drawing, thus distinguishing them from the second balance weights 4B formed from the material of less density.

Figure 14:
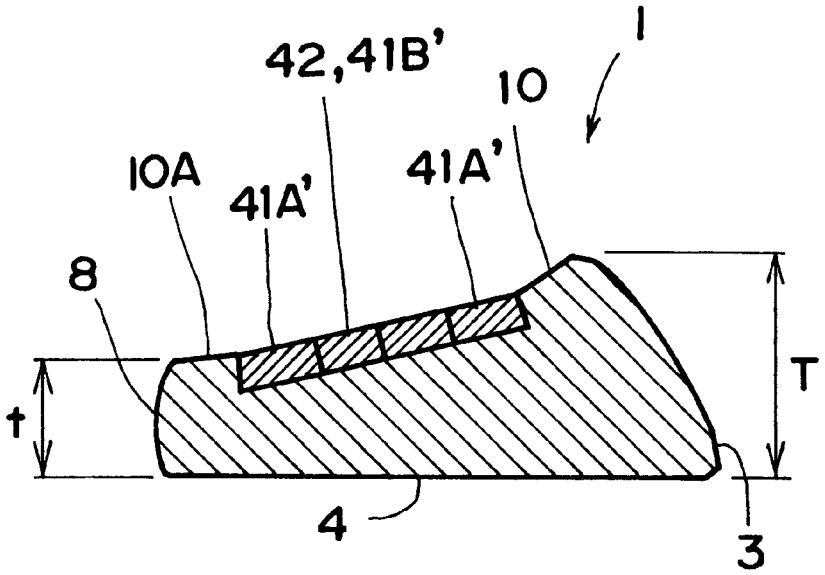
FIG. 14 is a section of an iron golf club in accordance with an eighth embodiment of the invention.

When striking a ball with the above-structured head, you swing the golf club, while gripping a grip portion (not shown) of the shaft 2 to strike a ball on the face 4. At that time, as the balance weights 41A and 41B are disposed in the recess 14 on the rear face 10 of the head 1, the weight balance of the head 1 can be freely adjusted, through the combination of the balance weights 41A and 41B of various shapes and specific gravity. Further, as the first balance weights 41A of larger density are positioned along the periphery of the bottom surface 15 of the recess 14, while the second balance weights 41B of smaller density are positioned along the inside periphery of the first balance weights 41A, the weight of the head 1 can be distributed in a ring-like manner around the center of gravity of the head 1, thereby enlarging the sweet area. Also, the position of the center of gravity and moment of inertia of the head 1, as well as the position of the sweet area thereof, can be freely set, in accordance with a particular use demanded. Moreover, the fine adjustment of these factors are also enabled. In addition to the foregoing, as the first and second balance weights 41A and 41B are disposed on the bottom surface 15 opposite to the face 4, the face 4 can be thickened to thereby improve the feel of striking. Referring to FIG. 14 showing an eighth embodiment, there is shown an iron golf club of so-called solid-back type whose head 1 has the rear face 10A provided with a plurality of fragmentary balance weights 41A' and 41B', like the seventh embodiment. The first balance weights 41A' are spacedly provided along the periphery, while the second balance weights 41B' are arranged along the inside periphery of the first balance weights 41A'. It should be noted that the specific gravity of the material of the first balance weights 41A' is greater than that of the second balance weights 41B', and that they are embedded so that the respective rear faces 42 are nearly flush with the rear portion 10A.

Incidentally, the present invention should not be limited to the foregoing embodiments, but may be modified within a scope of the invention.

What is claimed:

1. An iron golf club having a head body with a front face with a ball striking portion, a rear face which is nearly oppositely disposed to the ball striking portion of the front face, said rear face having substantially the same area and shape as the ball striking portion of the front face, and a shaft connected to one side of the head body, the golf club further comprising:

a plurality of balance weights provided on the rear face of said head body, each of said balance weights being separate from said head body, elongated from a top side of the head body toward a sole side thereof, arranged in parallel, at nearly equal intervals, wherein said balance weights have substantially the same width, and are securely fitted into grooves provided on the rear face of said head body in a mortise and tenon joint, wherein said rear face of the head body is nearly flush with respective rear faces of said balance weights, and wherein at least one of the balance weights provided near a toe or heel side on said rear face has a specific gravity that is greater than a specific gravity of at least one of the balance weights provided near a center of the rear face, and wherein at least one of the balance weights provided near the toe side on said rear face is longer than at least one of the balance weights provided near the heel side on the rear face.

2. An iron golf club having a head body with a front face having a ball striking portion, a rear face which is nearly oppositely disposed to the ball striking portion of the front face, said rear face having substantially the same area and shape as the ball striking portion of the front face, and a shaft connected to one side of the head body, the golf club further comprising:

a plurality of balance weights provided on the rear face of said head body, each of said balance weights being separate from said head body, elongated from a toe side of the head body toward a heel side thereof, arranged in parallel, at nearly equal intervals, wherein said balance weights are securely fitted into grooves provided on the rear face of said head body in a mortise and tenon joint, wherein said rear face of the head body is nearly flush with respective rear faces of said balance weights, and wherein at least one of the balance weights provided near a sole side on said rear face has a specific gravity that is greater than a specific gravity of at least one of the balance weights provided near a top side of the rear face, and wherein at least one of the balance weights provided near the sole side on said rear face is longer than at least one of the balance weights provided near the top side on the rear face.

3. An iron golf club having a head body with a front face having a ball striking portion, a rear face which is nearly oppositely disposed to the ball striking portion of the front face, said rear face having substantially the same area and shape as those of the ball striking portion of the front face, and a shaft connected to one side of the head body, the golf club further comprising:

a plurality of balance weights provided on the rear face of said head body, each of said balance weights being separate from said head body, formed into a fragmentary shape, wherein at least one of the balance weights provided on a peripheral side of said rear face has a specific gravity that is greater than a specific gravity of at least one of the balance weights provided on a center side of the rear face.

4. An iron golf club according to claim 3, wherein said rear face of the head body is formed with a cavity.

5. An iron golf club having a head body with a front face having a ball striking portion, a rear face and a shaft connected to one side of the head body, the golf club further comprising:

a plurality of balance weights provided on the rear face of said head body, each of said balance weights being separate from said head body, elongated from a top side of the head body toward a sole side thereof, arranged in parallel, at nearly equal intervals, wherein said balance weights have substantially the same width, and are securely fitted into grooves provided on the rear face of said head body in a mortise and tenon joint, wherein said rear face of the head body is formed with a cavity and a bottom face in the cavity that is nearly flush with rear faces of said balance weights, and wherein at least one of the balance weights is provided near a toe side on said rear face and is longer than at least one of the balance weights provided near a heel side on the rear face, and wherein said balance weights are provided on said bottom face, said bottom face being opposite to said ball striking portion of said front face and having substantially the same area and shape as the ball striking portion of the front face.

6. An iron golf club having a head body with a face and a shaft connected to one side of the head body, which comprises:

a plurality of balance weights provided on a rear face of said head body, each of said balance weights being separate from said head body, elongated from a toe side of the head body toward a heel side thereof, arranged in parallel, at nearly equal intervals, wherein said balance weights are securely fitted into grooves provided on the rear face of said head body in a mortise and tenon joint, wherein said rear face of the head body is formed with a cavity so that a bottom face of the cavity may be nearly flush with respective rear faces of said balance weights, and wherein at least one of the balance weights which is provided near the sole side on said rear face is longer than at least one of the balance weights which is provided near the top side on the rear face, and wherein said balance weights are provided on said bottom face, said bottom face being opposite to said ball striking portion of said front face, and having substantially the same area and shape as the ball striking portion of the front face.

* * * * *